United States Patent [19]

Prout

[11] 4,419,788

[45] Dec. 13, 1983

[54] ADJUSTABLE SPRING HINGE

[75] Inventor: Addison S. Prout, Columbus, N.C.

[73] Assignee: Bommer Industries, Inc., Landrum, S.C.

[21] Appl. No.: 271,995

[22] Filed: Jun. 9, 1981

[51] Int. Cl.[3] ..... E05F 1/12

[52] U.S. Cl. ..... 16/300

[58] Field of Search ..... 16/300, 301, 299, 273

[56] References Cited

U.S. PATENT DOCUMENTS

| | | |
|---|---|---|
| 6,112 | 11/1874 | Joyce . |
| 142,855 | 9/1873 | Joyce . |
| 1,954,934 | 4/1934 | Houdaille et al. . |
| 3,825,973 | 7/1974 | Gwozdz . |
| 3,898,708 | 8/1975 | Gwozdz . |
| 3,965,533 | 6/1976 | Frohlich . |
| 4,043,001 | 8/1977 | Parsons . |

FOREIGN PATENT DOCUMENTS

| | | | |
|---|---|---|---|
| 2305573 | 11/1976 | France . | |
| 880596 | of 1908 | United Kingdom | 16/30 |
| 343408 | 2/1981 | United Kingdom | 16/300 |

*Primary Examiner*—Werner H. Schroeder
*Assistant Examiner*—Andrew M. Falik
*Attorney, Agent, or Firm*—Luke J. Wilburn, Jr.; Wellington M. Manning, Jr.

[57] ABSTRACT

An spring hinge construction comprising a pair of hinge leaves having hollow knuckle portions axially aligned to form a hinge barrel containing a torsion spring. A pintle in each end of the barrel operatively engages an adjacent end of the spring to fix it against relative rotation. One pintle is fixed, through a leaf knuckle, to one hinge leaf, and the other pintle is rotationally adjustable to set a desired torsion on the spring, after which it is fixed against counter-rotation by means of a loose pin which is inserted through an elongate slot in a knuckle of the other leaf and into a selected radial passageway opening in the pintle which aligns with the end of the slot. An anti-friction bushing and thrust washer carried by the adjustable pintle and located between opposed surfaces of adjacent knuckles, respectively, cooperate to provide positive securement of the adjustable pintle in the hinge barrel while permitting its free rotation therein, and corresponding free smooth relative movement of the hinge knuckles during use of the hinge.

8 Claims, 4 Drawing Figures

ADJUSTABLE SPRING HINGE

This invention relates to a spring hinge construction, and, more particularly, to an improved hinge of the adjustable torsion spring type particularly adapted for use in automatic closure of doors.

BACKGROUND OF THE INVENTION

Spring hinges for continuously urging doors into a closed position are well known and have long been employed in the prior art. Many present building codes require automatic door closing devices in certain locations of use. Depending upon the size and weight of the door, as well as the environmental conditions to which it may be exposed, e.g., wind drafts and the like, it is generally desirable that spring hinge automatic door closing devices be capable of adjustment to vary the torsional force on the spring and the corresponding force of closure exerted by the spring hinge on the door which it supports.

Certain adjustable spring hinge constructions typically comprise a pair of opposed hinge leaves having hollow knuckle portions axially aligned to form a hinge barrel containing a torsion spring therein. Pintles located in each end of the hinge barrel extend through adjacent knuckles to maintain them in axial alignment and operatively engage an adjacent end of the torsion spring to fix the same against relative rotation to a knuckle of each respective hinge leaf. Torsional force of the spring may thus be established and adjusted by rotational positioning of one of the end pintles about the axis of the hinge barrel, with a stop pin being received through a pin opening in the wall of the knuckle which aligns with a selected pin opening in the pintle to fix the pintle against rotation. Generally, adjustable rotation of the pintle of such spring hinges is accomplished by means of a hex wrench or screwdriver which must be inserted into a preformed opening extending axially into the exposed end of the pintle to rotate the same, or a capstan type hub is provided on the exposed end of the pintle outside the knuckle for receipt of an adjusting rod to rotate the pintle to bring a selected pintle stop pin opening into alignment with the knuckle opening or hinge leaf edge. Adjustable spring hinges are illustrated in the following prior art patents: U.S. Pat. No. 6,112; U.S. Pat. No. 1,954,934; U.S. Pat. No. 3,825,973; U.S. Pat. No. 3,898,708; U.S. Pat. No. 3,965,533; U.S. Pat. No. 4,043,001; and French Pat. No. 2,305,573.

Generally such spring hinge constructions of the type described may be pretensioned to provide a desired closure force, or they may be adjusted after installation on a door to provide the proper closure force for the size, weight and environmental conditions of use of the door. Due to space limitations in the location of use of the door hinge, such as in areas close to corners of rooms or with doors have heavy or protruding door frame molding, it is often difficult to accurately view and rotatably position the adjusting pintle by use of a screwdriver or hex wrench inserted into an axial opening in the end of the pintle. Similarly, the use of a protruding capstan on the end of the pintle for rotational adjustment necessarily results in increasing the size or length of the hinge beyond that necessary for support of the door.

In many door hinge constructions, it is also often desirable to provide anti-friction surfaces between the relatively moving metal parts of the door hinge, such as between pintle and knuckle surfaces, and between adjacent knuckle surfaces of opposite leaves of the hinge, to facilitate smooth relative movement of the hinge leaves about the hinge barrel axis during swinging of the door. In such pintle adjusting spring door hinge constructions, it is often difficult to provide ready access to rotational adjustment of the pintle as well as an anti-friction surface for movement of the hinge, while still ensuring that the adjustable pintle remains firmly secured in the end of the hinge barrel, regardless of the orientation of the hinge.

BRIEF OBJECTS OF THE PRESENT INVENTION

It is an object of the present invention to provide an improved adjustable spring hinge of compact construction wherein the torsional force of the spring of the hinge may be easily adjusted after installation of the hinge on a door, and particularly where there is limited space for use of or access to the hinge for adjustment.

It is a further object to provide a compact, adjustable spring hinge of economical construction and ease of assembly wherein the spring-adjusting pintle of the hinge is provided with an anti-friction bushing and thrust washer arrangement for support as well as positive securement in the barrel of the hinge, and wherein ready access is provided to the pintle for precise adjustment of the spring torsion of the hinge.

BRIEF DESCRIPTION OF THE DRAWINGS

The above as well as other objects of the invention will become more apparent from the following detailed description of preferred embodiments thereof, when taken with the accompanying drawings, in which.

BRIEF SUMMARY OF THE INVENTION

Briefly, the present invention comprises a spring hinge. construction comprising opposed hinge leaves having hollow knuckle portions axially aligned to form a hinge barrel which contains a torsion spring. A pintle in each end of the barrel operatively engages an adjacent end of the spring to fix it against relative rotation, through a leaf knuckle, to a respective hinge leaf, and one of the pintles is rotationally adjustable to set a desired torsion on the spring. The position of the adjustable pintle is then fixed against counter-rotation by means of a loose pin which is inserted through an elongate slot in a leaf knuckle and into a selected radial passageway opening in the pintle. The knuckle slot exposes at least three radial passageway openings for selectively receiving a simple adjusting rod which is then pivoted along the slot to rotatably position and apply a desired tension to the torsion spring after which the loose stop pin is inserted into a pintle passageway opening at the end of the knuckle slot to prevent counter-rotation of the pintle relative to the knuckle. An anti-friction bushing and thrust washer arrangement carried by the adjustable pintle and located between opposed surfaces of adjacent knuckles, respectively, cooperate to provide positive securement of the adjustable pintle in the hinge barrel while permitting its free smooth relative rotation therein, and corresponding free smooth relative movement of the hinge knuckles during use of the hinge.

DETAILED DESCRIPTION OF PREFERRED EMBODIMENTS

Figure 1:
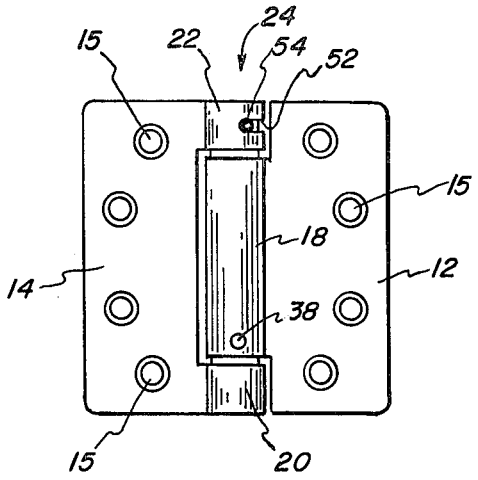
FIG. 1 is a front elevation view of a spring hinge construction of the present invention.
Figure 2:
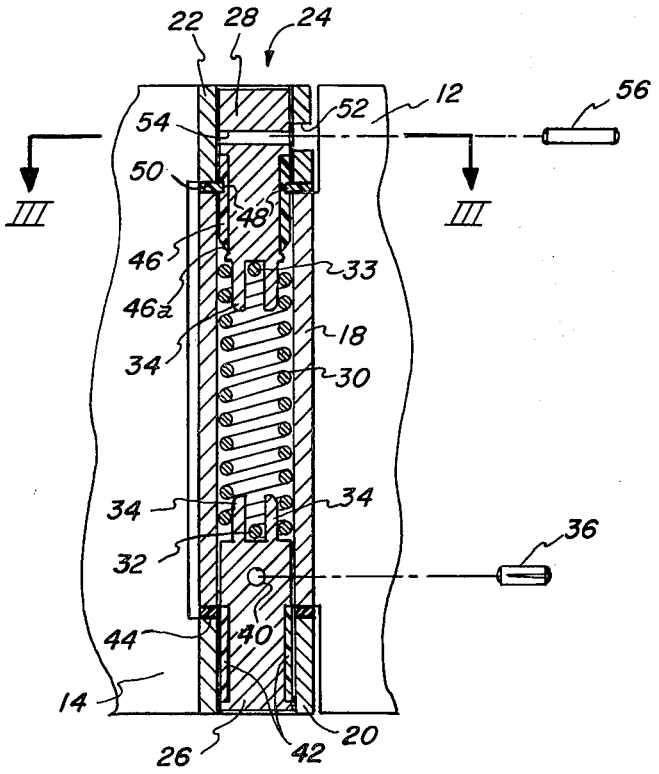
FIG. 2 is an enlarged vertical cross section view of the hinge of FIG. 1, with portions of the hinge leaves broken away for convenience.

Referring more specifically to the drawings, FIG. 1 illustrates a preferred form of hinge construction of the present invention which comprises a pair of hinge leaves 12, 14, having screw openings 15 for attachment of the respective leaves to a door and door jamb. Adjacent side edges of the hinges are provided with an integral hollow knuckles. As seen in FIGS. 1 and 2, the edge of hinge leaf 12 has a central hollow knuckle 18 which is located between two spaced end knuckles 20, 22 on hinge leaf 14 in axial alignment therewith to form a hollow barrel 24 of the hinge.

As best seen in FIG. 2, knuckles 20, 22 of hinge leaf 14 and the knuckle 18 of hinge leaf 12 are maintained in axial alignment during their relative movement by means of a pair of generally cylindrical pintles 26, 28 which extend into the ends of the hinge barrel 24 through respective adjacent leaf knuckles 20, 22 and into the ends of leaf knuckle 18. Located within the hollow knuckle 18 of the hinge barrel between pintles 26, 28 is a torsion spring 30, the opposite ends 32, 33, of which are operatively secured between extending finger projections 34 on the inner ends of the respective pintles 26, 28 to fix each end of the spring against relative rotation with respect to its immediately adjacent pintle.

Pintle 26 at the bottom end of the hinge barrel is fixed against rotation to the knuckle 18 of hinge leaf 12 by means of a fastening pin 36 which is received through an aligned opening 38 in the lower wall portion of the knuckle (FIG. 1) and a passageway 40 extending radially through pintle 26. A lower peripheral surface portion of pintle 26 is undercut to form a circumferential recess or channel in the pintle which carries an anti-friction bushing 42, such as a two-piece semicircularly split, nylon bushing. Bushing 42 serves to facilitate rotational movement of knuckle 20 of hinge leaf 14 about the fixed pintle 26 held fast on supporting knuckle 18. Also located between the adjacent end surfaces of knuckle 18 and knuckle 20 is a plastic thrust washer 44 which serves as an anti-friction bearing surface between the knuckles 18 and 20 during their relative movement.

Figure 3:
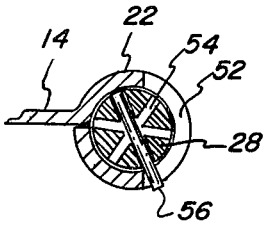
FIG. 3 is a horizontal cross sectional view of the hinge barrel of FIG. 2, taken generally along line III—III of FIG. 2 and looking in the direction of the arrows.
Figure 4:
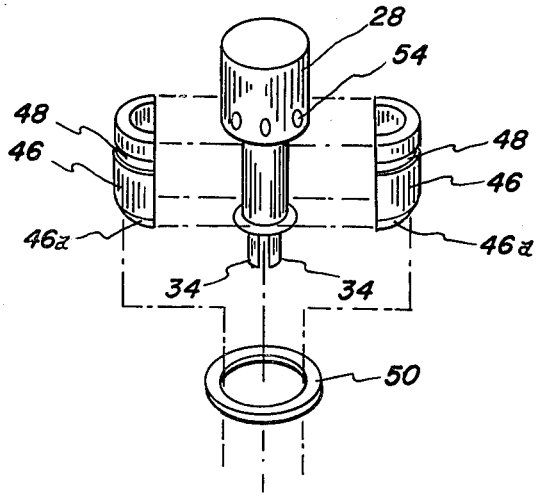
FIG. 4 is an exploded front elevational view of the adjustable pintle, with its supporting elements, of the hinge.

As seen in FIGS. 2–4, upper pintle 28 of the spring hinge is of generally cylindrical cross sectional shape and extends through knuckle 22 and into the end portion of knuckle 18 of hinge leaf 12. Carried in a circumferential annular channel which is formed by an undercut portion of the peripheral surface of pintle 28 is an anti-friction bushing 46, such as a two-piece, semi-circularly split nylon bushing. Located in the outer periphery of bushing 46 is an annular groove or recess 48 which receives the inner portion of an anti-friction thrust washer 50 located between the adjacent ends of knuckles 18 and 22. Thrust washer 50 is formed of suitable resiliently deformable anti-friction material, such as nylon plastic, or the like. As can be seen, the opening through thrust washer 50 is of smaller diameter than the external diameter of the major portion of bushing 46, as well as the internal diameter of the hinge barrel 26. The interior portion of the thrust washer 50 thus resides in the annular bushing groove 48 to positively lock the pintle 28 in snap-fit relation in the end of the hinge barrel, while still permitting its free rotation about the axis of the barrel. As mentioned, the thrust washer 50 is sufficiently resilient so as to be deformed to enlarge its central opening and permit the insertion of the pintle 28 and bushing 46 through the washer during assembly of the hinge, as will be explained. To facilitate insertion of the pintle and bushing through the washer opening, the lower end surface portion **46*a* of bushing 46 is tapered inwardly (FIG. 2**) to a smaller diameter than the thrust washer opening to guide the bushing and pintle through the opening during downward forced movement of the pintle into the hollow barrel.

For ready adjustment of the torsional force of the spring 30, knuckle 22 of hinge leaf 14 is provided with an elongate horizontal slot 52 which extends approximately 180° about the circumference of the knuckle (FIGS. 2 and 3). Pintle 28 is provided with a plurality of radial passageways 54 spaced about the circumference of the pintle which become sequentially aligned with knuckle slot 52 during rotation of pintle 28 to expose them for insertion of a loose stop pin 56. The length of the horizontal slot 52 of knuckle 22 is sufficient to simultaneously expose three radial passageway openings of the pintle so that pintle 28 may be easily moved by use of a small metal tension rod or nail inserted into one of the exposed passageway openings and pivoted along the slot to rotate the pintle in a desired direction and vary the torsional force on the spring. When the desired force is applied to the spring, the loose stop pin 56 is inserted into a passageway opening of pintle 28 which resides adjacent an end of the knuckle slot 52 (note FIG. 3) to lock the pintle and spring against counter-rotation relative to knuckle 22 and hinge leaf 14.

The hinge leaves, knuckles, and pintles are made of suitable high strength material, such as low carbon steel, brass, or the like. By provision of the anti-friction thrust washers and bushings made of suitable plastic or other similar type material, it can be appreciated that metal to metal contact between the relatively moving surfaces of the hinge is eliminated. By providing the particular elongate slot with pintle radial passageways and loose pin locking arrangement as herein described, it can be appreciated that torsion on the spring may be quickly and easily adjusted by an operator by insertion of a simple metal rod, even a nail, into a selected passageway opening visually observable through the knuckle slot.

The improved spring hinge construction of the present invention may be easily manufactured and assembled from a minimal number of component parts. To assemble the hinge, the knuckles 18, 20, 22 of the hinge leaves 12, 14 are axially aligned, as seen in FIGS. 1 and 2, with the thrust washers 44, 50 located between the adjacent ends of the knuckles. Pintle 26 carrying its anti-friction bushing 42 is then inserted into the lower end of the hinge barrel and fixed securely therein by means of the fast pin 36 which is press fit into the aligned opening 38 of knuckle 18 and resides in pintle passageway 40.

Spring 30 is then inserted into the hollow central knuckle 18 through the upper knuckle and barrel opening to operatively engage the lower end 32 of the spring with the finger projections 34 on pintle 26 and prevent relative rotational movement of the lower end of the spring with respect to pintle 26, knuckle 18, and hinge leaf 12.

With the thrust washer 50 positioned between the opposed ends of the knuckles 18 and 22, pintle 28 carrying its anti-friction bushing 46 is inserted downwardly into the upper opening of the knuckle to bring the tapered surface 46*a* of the bushing into engagement with the reduced diameter inner portion of thrust washer 50. Pintle 28 is then thereafter forced by pressure downwardly to expand the reduced diameter internal opening of thrust washer 50 until the thrust washer snaps inwardly to reside within the groove 48 of the bushing, thus securely locking pintle 28 in the end of the barrel while permitting its relative rotational movement about the barrel axis.

That which is claimed is:

1. A spring hinge comprising a pair of hinge leaves having hollow knuckles on adjacent edges located in end to end axial alignment to form a hollow hinge barrel, first and second pintles positioned in respective ends of the hinge barrel and extending into and between axially aligned knuckles of adjacent leaves to maintain them in axial alignment during their relative movement, means fixing said first pintle to a knuckle of one of said pair of said hinge leaves to prevent relative rotational movement therebetween, a torsion spring located in said hollow barrel and extending between said first and second pintles, said spring having each of its end portions operatively connected to a respective adjacent pintle to prevent relative rotation therebetween, a bushing carried on a reduced diameter portion of the peripheral surface of said second pintle and extending axially therealong to engage the inner surfaces of adjacent knuckles, said bushing having a circumferential groove on its outer surface, a resiliently deformable thrust washer positioned between the adjacent ends of said adjacent knuckles in circumferentially surrounding relation to said bushing, said washer having an internal diameter which is less than the internal diameter of said barrel and the external diameter of the bushing adjacent its groove to reside in said bushing groove and thereby retain said second pintle in said barrel while permitting its rotational movement about the axis of the same, and means for adjustably rotatably positioning said second pintle and fixing it against rotation in one direction relative to a knuckle of the other of said pair of hinge leaves whereby the torsional force exerted by said spring between said pair of hinge leaves may be adjusted.

2. A spring hinge as defined in claim 1 wherein said means for adjustably positioning and fixing said second pintle comprises a plurality of radial passageways having openings spaced about the periphery of said second pintle at a position within said knuckle of said other hinge leaf, and an elongate slot in said knuckle extending for an appreciable distance about the periphery of said knuckle to expose multiple of the pintle passageway openings for receipt of a stop pin therein.

3. A spring hinge as defined in claim 2 wherein said slot extends for a sufficient distance about said knuckle to expose at least three of said passageway openings to permit insertion of a tool through said slot and into a selected one of said passageway openings for rotational movement of said second pintle about the axis of said hinge barrel.

4. A spring hinge as defined in claim 1 wherein said bushing carried by said second pintle is of generally cylindrical shape, said reduced diameter portion of said second pintle comprises a circumferential channel about the periphery of said pintle for supportably receiving and retaining said bushing against axial movement along said pintle, and the surface portion of the end of said bushing adjacent the inner end of said pintle being tapered inwardly to a reduced diameter to facilitate insertion of said pintle and bushing into and through the opening in said thrust washer during assembly of the spring hinge.

5. A spring hinge as defined in claim 4 wherein said bushing is longitudinally split, and said bushing and thrust washer are formed of plastic materials having a low coefficient of surface friction to facilitate relative movement of said pintle and adjacent knuckles of said spring hinge leaves.

6. A spring hinge as defined in claim 2 wherein said knuckle slot extends approximately 180° about the circumference of said knuckle, and wherein the second pintle is held against rotation in said one direction by a stop pin inserted into a pintle passageway and engaged with an end edge portion of said knuckle slot.

7. A spring hinge comprising a pair of hinge leaves having hollow knuckles on adjacent edges located in end to end axial alignment to form an elongate hollow hinge barrel, a pintle positioned within one end of said barrel and extending into and between axially aligned knuckles of adjacent leaves to maintain the knuckles in axial alignment during their relative movement, means locking the pintle against axial movement along the barrel while permitting its free rotational movement about the barrel axis, a torsion spring located in said hollow barrel, means fixing a first end of said spring against relative rotation with respect to one of said hinge leaves, the other end of said spring being operatively connected to the inner end of said pintle and fixed against relative rotation with respect thereto, and means for adjustably rotatably positioning said pintle and fixing it against rotation in one direction relative to a knuckle of the other of said pair of hinge leaves whereby a desired torsional force may be applied to the spring and exerted by said spring between said pair of hinge leaves, said means for adjustably positioning and fixing said pintle comprising an elongate slot extending about a portion of the periphery of said knuckle of the other hinge leaf, a plurality of radial passageways spaced about the peripheral circumference of said pintle and from the end of the pintle to reside within said knuckle and in alignment with said slot during rotation of the pintle, said slot being of sufficient length to simultaneously expose multiple of said pintle passageways, whereby a rod member may be inserted into said slot and a pintle passageway and moved along the slot to tension said spring, and a stop pin for insertion into a pintle passageway in engagement with an end edge of said slot to prevent rotation of said pintle in said one direction.

8. A spring hinge as defined in claim 7 wherein said means fixing said one end of said spring against relative rotation with respect to said one of said hinge leaves comprises a pintle positioned in the opposite end of the hinge barrel from said first pintle and operatively engaging said spring end to prevent relative rotation therebetween, and pin means fixing said second pintle against relative rotation with respect to a hollow knuckle of said one of said hinge leaves.

* * * * *